US005476059A

United States Patent [19]

Pollack

[11] Patent Number: 5,476,059

[45] Date of Patent: Dec. 19, 1995

[54] TURRET DRIVE MECHANISM

[75] Inventor: Jack Pollack, Calabasas Hills, Calif.

[73] Assignee: Imodco, Inc., Calabasas Hills, Calif.

[21] Appl. No.: 360,985

[22] Filed: Dec. 20, 1994

[51] Int. Cl.[6] ..... B63B 21/00

[52] U.S. Cl. ..... 114/230; 114/293

[58] Field of Search ..... 114/230, 293; 441/3–5; 254/389, 415, 417; 242/615.3, 397.1

[56] References Cited

U.S. PATENT DOCUMENTS

| | | | |
|---|---|---|---|
| 3,535,883 | 10/1970 | Manning | 114/230 |
| 3,841,685 | 10/1974 | Kolodziej | 114/230 |
| 3,883,912 | 5/1975 | Pedersen | 9/8 P |
| 4,130,076 | 12/1978 | van Bilderbeek | 114/230 |
| 4,176,615 | 12/1979 | Reid et al. | 114/230 |
| 4,396,046 | 8/1983 | Kentosh | 141/387 |
| 4,533,332 | 8/1985 | Coppens et al. | 441/3 |
| 4,534,740 | 8/1985 | Poldervaart | 441/3 |
| 4,602,586 | 7/1986 | Ortloff | 114/230 |
| 4,617,000 | 10/1986 | Girardot et al. | 441/3 |
| 4,645,467 | 2/1987 | Pollack | 441/4 |
| 4,907,995 | 3/1990 | Poldervaart et al. | 441/3 |
| 5,025,742 | 6/1991 | Urdshals | 114/230 |
| 5,237,948 | 8/1993 | Hvide | 114/230 |
| 5,305,703 | 4/1994 | Korsgaard | 441/4 |
| 5,381,750 | 1/1995 | Pollack | 114/230 |

FOREIGN PATENT DOCUMENTS

| | | | |
|---|---|---|---|
| 0150891 | 7/1986 | Japan | 114/293 |

*Primary Examiner*—Edwin L. Swinehart
*Attorney, Agent, or Firm*—Freilich Hornbaker Rosen

[57] ABSTRACT

A torque enhancer (60, FIG. 1) is provided for an offshore system wherein a turret (18) is rotatably mounted about a vertical axis (22) on a vessel hull and the turret is anchored by catenary chain devices (24), to help minimize rotation of the turret when the vessel weathervanes. The torque enhancer may include a pair of members (80, 82, FIG. 3) with horizontally-spaced inner ends (84, 86) pivotally mounted on the turret and with outer ends (90, 92) coupled to a chain device (24) to transmit horizontal components (E) of tension force that tend to turn the turret to maintain it at its initial rotational orientation with respect to the seafloor. In one system, the arms are rigid beams arranged to form an A-frame, with the outer ends of the arms supporting a guide (100) and with the chain device slidably extending through the guide and attached to the vessel half way between the inner ends of the beams. In another system, a pair of chains (122, 124, FIG. 4) or other flexible tension members couple a chain device (136) to horizontally spaced locations on the turret.

12 Claims, 3 Drawing Sheets

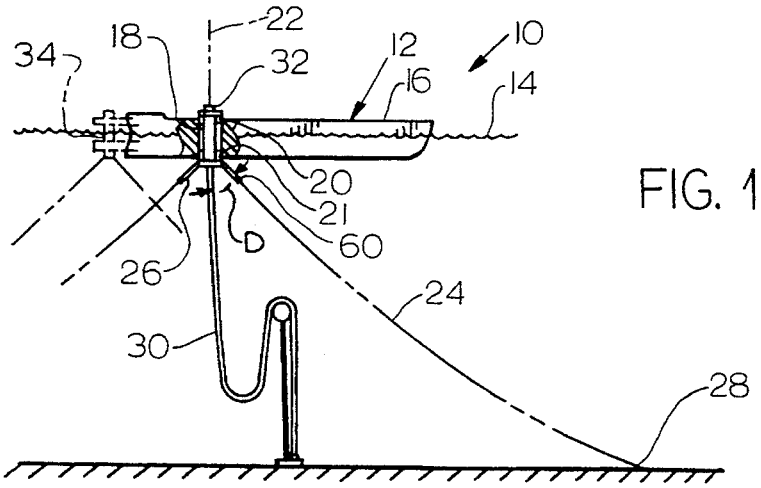
FIG. 1
FIG. 2
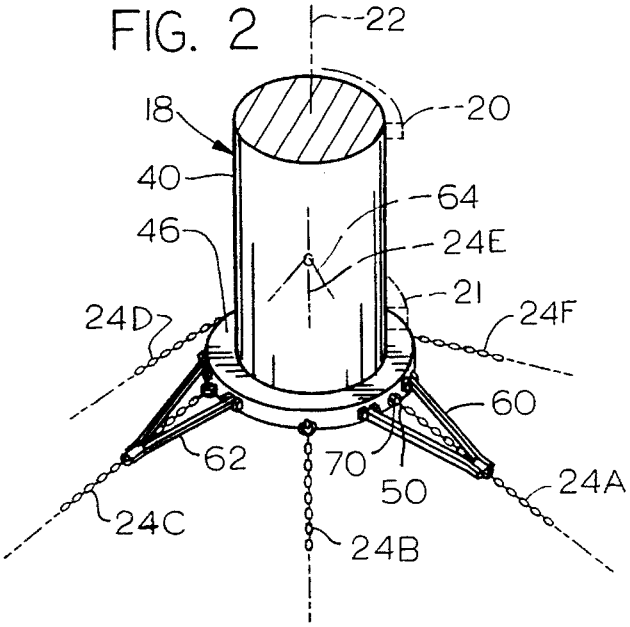
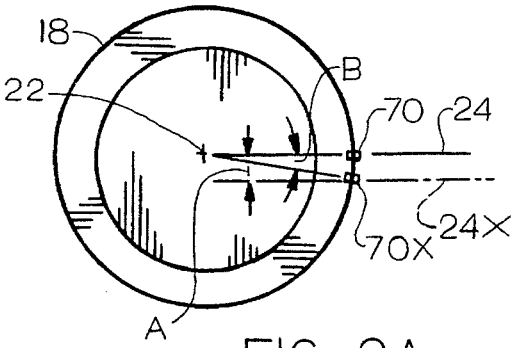
FIG. 2A
PRIOR ART
FIG. 3
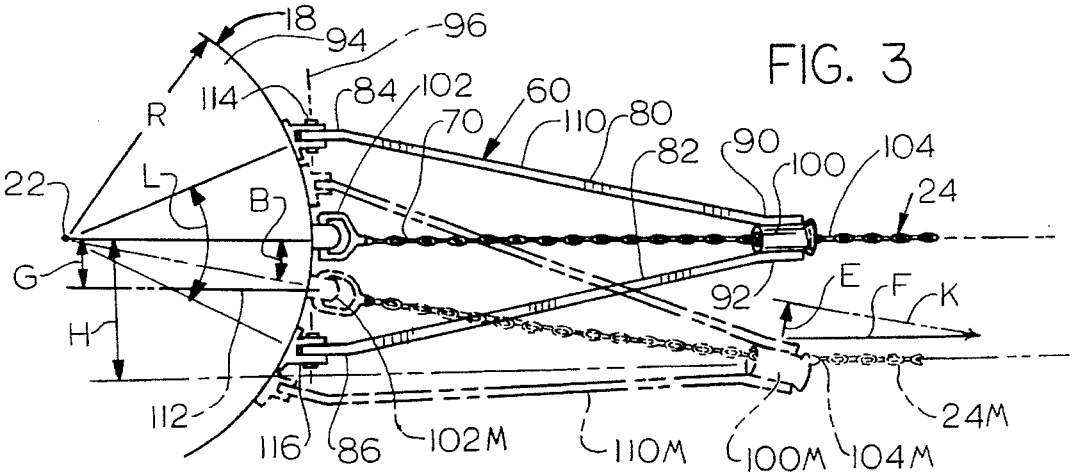

TURRET DRIVE MECHANISM

BACKGROUND OF THE INVENTION

A common type of offshore system for producing hydrocarbons, includes a vessel floating at the sea surface and having a turret rotatably mounted about a vertical axis on the vessel hull, and a group of catenary chains extending at downward inclines to the seafloor. The vessel weathervanes (turns to head in different directions) with changing winds, waves, and currents. The turret is prevented from rotating with the vessel by the fact that when the turret turns, horizontal components of force applied by the chains are in directions that do not pass through the axis of rotation, and these horizontal components therefore apply a torque tending to restore the turret to its initial or quiescent rotational orientation.

Friction in the bearings that rotatably support the turret on the vessel hull result in the turret initially turning with the vessel away from the quiescent turret position. Such misalignment (with respect to the quiescent turret position) continues until the torque applied by the mooring chains overcomes the bearing friction. If the misalignment angle at which the turret begins to turn back is large, then such misalignment can cause wear in chain attachment points, twist in flow lines, and large unexpected dynamic turret rotations. Unexpected dynamic turret rotation occurs when large alignment torque and consequent forces applied by the anchor chains, first exceed static friction of the bearings and begin turret rotation. Once the turret begins to rotate, the bearings apply only dynamic friction which is much less than static friction, resulting in rapid turret rotation. Significant turret misalignment (from its quiescent orientation) is especially likely in large and heavy turrets that have large diameter bearing systems. While it is possible to provide an electric motor that turns the turret when sensors detect misalignment, it is generally preferred that a nonactive system be used for greater reliability. A mechanism that could increase the torque applied by mooring chains or other chain devices (e.g. cables as well as chains), to help turn a turret back towards its quiescent orientation, would be of considerable value.

SUMMARY OF THE INVENTION

In accordance with one embodiment of the present invention, a torque enhancer is provided for increasing the torque applied by mooring chain devices to a turret to help turn back a rotated turret towards its quiescent position. The torque enhancer has an inner end mounted on the turret and an outer end extending away from the periphery of the turret by a considerable distance such as at least one meter. A mooring chain device that moors the vessel, is coupled to the outer end of the torque enhancer to apply thereto horizontal subcomponents of chain forces that tend to rotate the turret.

The torque enhancer preferably comprises a pair of members with widely spaced inner ends mounted on the turret and with adjacent outer ends. The inner ends can each pivot about a largely horizontal axis on the turret and the outer ends are coupled to the mooring chain device. In one such torque enhancer, the pair of members are substantially rigid beams, and their outer ends support a guide that slidably engages a mooring chain device. In another arrangement, each of the members is a tension member (chain or cable) whose outer end is fixed to the mooring chain device.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partially sectional side elevation view of an offshore system constructed in accordance with one embodiment of the present invention.

FIG. 2 is an isometric view of a portion of the system of FIG. 1.

FIG. 2A is a plan view of a prior art system.

FIG. 3 is a plan view of a portion of the system of FIG. 2.

DESCRIPTION OF THE PREFERRED EMBODIMENTS

Figure 4:
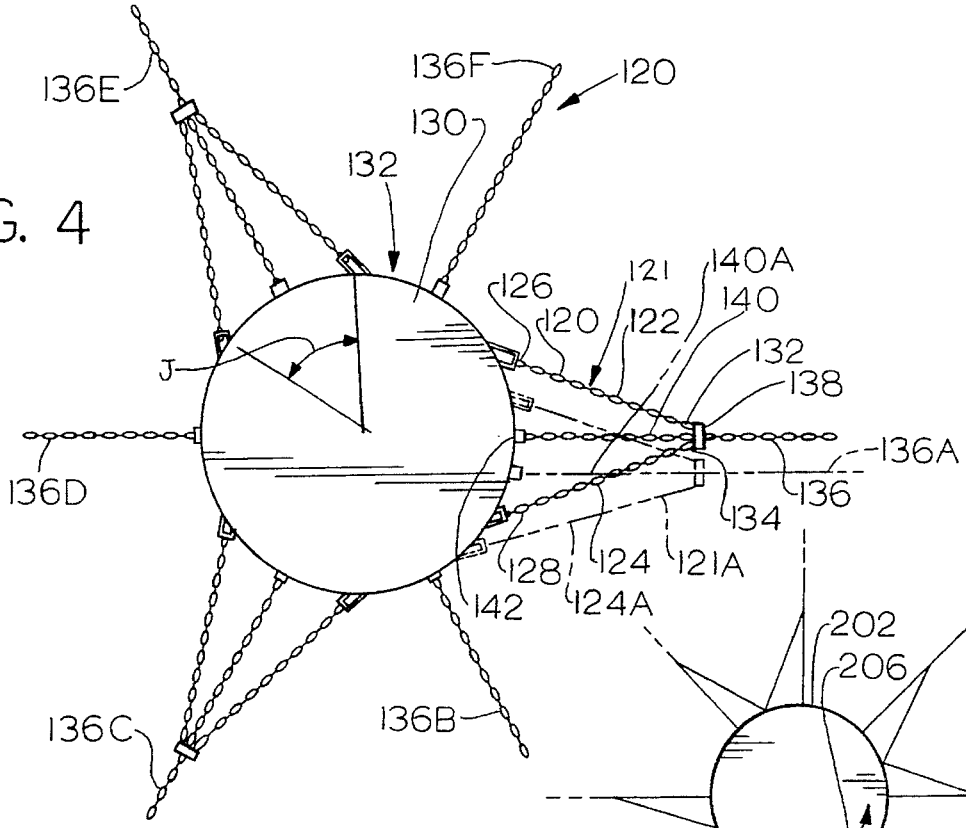
FIG. 4 is a plan view of a portion of a system constructed in accordance with another embodiment of the invention.

FIG. 1 illustrates an offshore system 10 which includes a vessel 12 that floats at the sea surface 14. The vessel includes a hull 16 and a turret 18 rotatably mounted by bearings 20, 21 about a substantially vertical axis 22 on the hull. The vessel is anchored by a group mooring chain devices 24 that have upper ends 26 coupled to the turret and lower ends 28 that extend along and are anchored to the seafloor. In the particular system shown, a fluid conduit 30 extends from wells at the seafloor and up through the turret 18 and through a fluid swivel 32 to processing equipment on the vessel. While the turret 18 is shown as mounted within a "moon pool" within the vessel hull, it should be noted that it is possible to mount a turret such as indicated at 34, outboard of the vessel hull.

FIG. 2 shows the turret 18 and six mooring chain devices 24A–24F that each extend at a downward incline from the turret 18 to the seafloor, but in different compass directions. It can be seen that the turret 18 includes a midportion 40 which is rotatably supported by the bearings 20, 21 (or a single bearing), and a chain table 46 where the extreme upper ends 50 of the mooring chain devices are attached. Three torque enhancers 60, 62, 64 are used with three of the six chain devices.

FIG. 2A shows a prior art system wherein mooring chains such as 24 were connected to a chain stopper 70 at the periphery of the turret 18, but without any torque enhancer. In the quiescent position, wherein the chain stopper was at 70, the mooring chain device applied a horizontal force in a direction that passed through the axis at rotation 22 of the turret. When the vessel weathervaned and the turret did not turn, the chain stopper might move to the position 70X. In that position, the horizontal force component applied by the mooring chain device at 24X passed along a line spaced a distance A from the axis of rotation 22. This resulted in a torque equal to the horizontal component of chain tension times the moment arm A of the torque. In moderate weather conditions, when the horizontal component was moderate, the restoring torque was also moderate, and this torque might not overcome bearing friction until the angle B of turret rotation was considerable. Such turning of the turret from its quiescent position, can cause wear at the chain attachment points such as at the chain stopper 70, and cause twist and fatigue damage in the fluid conduit 30 (FIG. 1). In addition, if the angle B (FIG. 2A) becomes large, then when the turret begins to turn and the static friction of the bearings becomes sliding or dynamic friction, then the turret might rapidly turn and cause injury to personnel. The torque enhancer 60 (FIG. 2) of the present invention increases the torque applied to the turret by effectively increasing the length of the moment arm at which the horizontal components of mooring chain device forces are applied.

FIG. 3 shows some details of the torque enhancer 60, which includes a pair of members 80, 82 with radially inner ends 84, 86 and radially outer ends 90, 92. The inner ends 84, 86 are spaced apart around the peripheral area 94 of the turret, which may be referred to as the periphery. The inner ends are angularly spaced apart with respect to the vertical axis by an angle L that is preferably at least 10°, and more preferably greater than 20°. The inner ends of the members are each pivotally mounted about coincident horizontal axes 96 on the turret. As a result, the outer ends of the members can move up and down as the incline angle (D in FIG. 1) of the mooring chain device 24 changes. The outer ends 90, 92 of the members preferably lie adjacent to each other. A chain device guide 100 is coupled to the outer ends of the members, and the chain device 24 passes through the guide and can slide therewithin. The particular guide 100 is in the form of a fairlead. The pivotal mounting of the A-frame torque enhancer 60 results in substantially no part of the vertical component of tension in the mooring chain device 24 being transferred to the torque enhancer. Also, horizontal subcomponents of chain device forces that do not urge turret pivoting, are transferred through an inner or upper chain portion 70 to the turret. However, the wide spacing of the inner ends 84, 86 of the members allows them to transfer horizontal subcomponents of mooring chain device force or loads that urge turret rotation, to the turret. The inner portion 70 of the mooring chain device is pivotally connected by a joint 102 to the turret, with the joint 102 permitting pivoting about a horizontal axis while also allowing limited rocking or pivoting about a vertical axis.

FIG. 3 shows in phantom lines, the turret having rotated from its quiescent position by an angle B of about 10° wherein the joint 102 moves to the position 102M. In that case, a location 104 at the upper end of the chain device, which lies outward of the guide 100, will move to the position 104M. This causes a bend in the chain device at the guide at 100M, resulting in a subcomponent E of the chain device horizontal load component F being applied to the guide 100M, and urging it to move the A-frame from the position 110M back to the position 110. The long radial distance (from axis 22) of the guide 100 from the axis 22 of the turret, results in the force E applying a large torque tending to turn the turret back to its quiescent position (wherein the chain device 24 extends through the turret axis 22). The major subcomponent K of the horizontal force component is applied through the inner chain portion 70 to the turret.

In the absence of the torque enhancer 60, the chain device would extend along the direction of line 112 through the joint at 102M, and the horizontal force component would be applied at a torque arm distance G from the turret axis 22. The addition of applicant's torque enhancer 60 results in the horizontal force component being applied at a torque arm distance H from the axis, where the torque arm H is much larger than the original torque arm G. The result is that a much larger restoring torque is applied to the turret to return it to its quiescent position. Where the torque arm H is twice as great as the torque arm G, this would result in a sufficient torque to begin returning the turret towards its quiescent position, after the turret has turned by half the angle.

Each of the members 80, 82 of the A-frame 110 is a beam or column, that resists bending and column collapse, in addition to withstanding tension forces. While the joint 102 may be an ordinary chain stopper which must withstand very high loads, the joints 114, 116 where the inner ends of the members are pivotally connected to the turret, have to withstand only much smaller loads and do not have to be as strong as the chain stopper joint at 102.

FIG. 4 illustrates another system 120 similar to that of FIGS. 1–3, except that each torque enhancer such as 121 includes two members 122, 124 that are tension members, such as chains or cables which can transmit large tension forces but substantially no compression or bending forces (less than 10% of tension forces). Each tension member 122, 124 has an inner end 126, 128 that is pivotally mounted at the peripheral region or periphery 130 of the turret 132. The pivotal joints at 126, 128 can rely solely on pivoting of chain links with respect to each other, or can include a sturdier joint that is more resistant to wear or fatigue of a cable. In this case, the outer ends 132, 134 of the tension members are fixed to the mooring chain device 136 at a clamping location 138. A third leg 140 of the arrangement can include an extension of the mooring chain device 136 or a separate tension member.

When the turret turns, as when the torque enhancer moves from position 121 to 121A, more of the horizontal force will be transmitted through the member at 124A than originally through the members 122, 124. This results in much greater torque being applied to restore the turret to its quiescent position, than if all of the horizontal forces were transmitted only through the third leg 140 which moves to the position 140A. In order to achieve the increased torque over a considerable angle of vessel turning, applicant prefers that the inner ends 126, 128 of the tension members be angularly spaced by a considerable angle J of at least 20° and preferably at least 30°. It may be noted in FIG. 4, that torque enhancers 121 are provided for only three of the six mooring chain devices 136A–136F.

Figure 5:
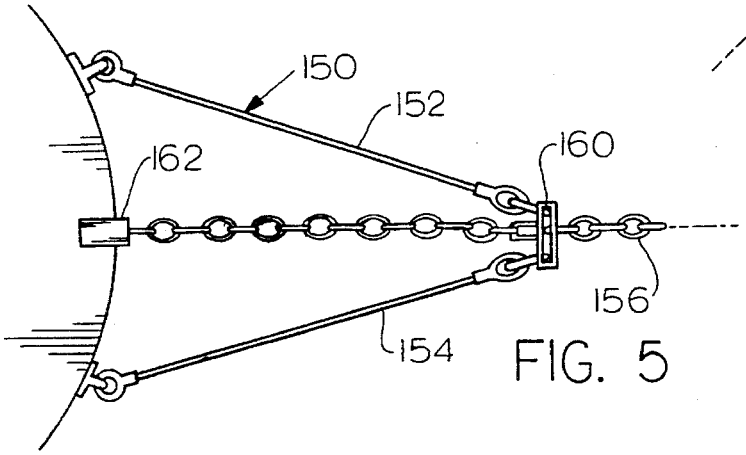
FIG. 5 is a partial plan view of a system constructed in accordance with still another embodiment of the invention.

FIG. 5 shows an arrangement similar to that of FIG. 4, except that the torque enhancer 150 includes cable-type tension members 152, 154. The mooring chain device 156 extends through a clamp 160 that clamps all of the members together, with the mooring chain device extending to a chain stopper at 162.

Figure 6:
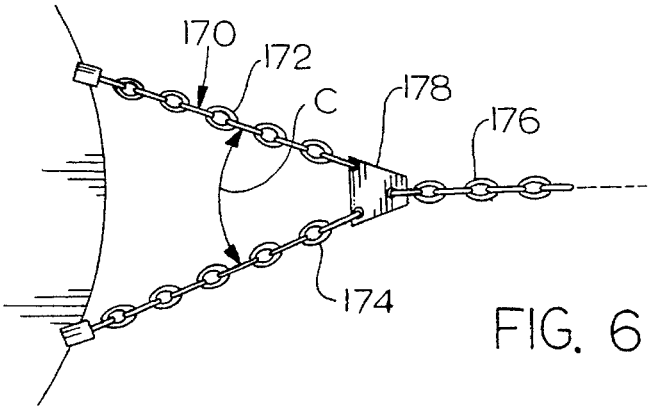
FIG. 6 is a partial plan view of a system constructed in accordance with yet another embodiment of the invention.

FIG. 6 illustrates still another torque enhancer 170 which includes only two tension members 172, 174, and with a mooring chain device 176 extending only to a coupling 178 where the two members and the mooring chain devices are clamped together.

Figure 7:
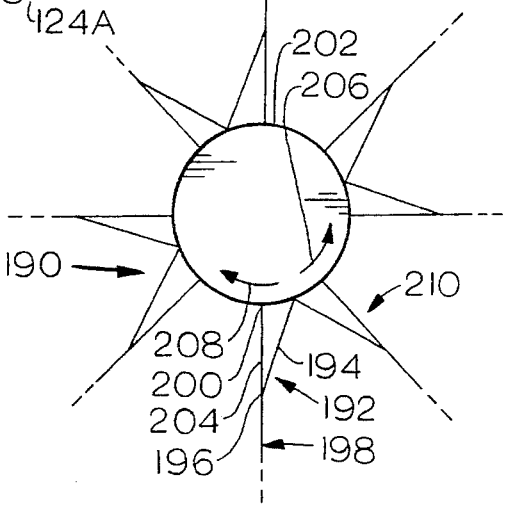
FIG. 7 is a simplified plan view of a system constructed in accordance with yet another embodiment of the invention.

FIG. 7 illustrates another system 190 wherein each torque enhancer 192 includes a member 194 extending from a location 196 of each mooring chain device 198. However each mooring chain device 198 has an inner end 200 that is attached to the turret 202. We may first assume that each member 194 is a tension member that can transmit only tension force. In operation, this torque enhancer operates in the same manner as that of FIG. 6, in that the leg 204 of the mooring chain device 198 and the member 194 will form two members of a torque enhancer, except that the members will be of different lengths. For turret rotation in the counter clockwise direction 206, the torque enhancer 210 will be effective in applying high torque to restore the turret. For rotation in the opposite clockwise direction 208, a next adjacent torque enhancer 192 will be effective in turning back the turret. If the member 194 of each torque enhancer is a beam that resists bending and collapse, then each torque enhancer can apply torque for turret rotation in either direction.

Figure 8:
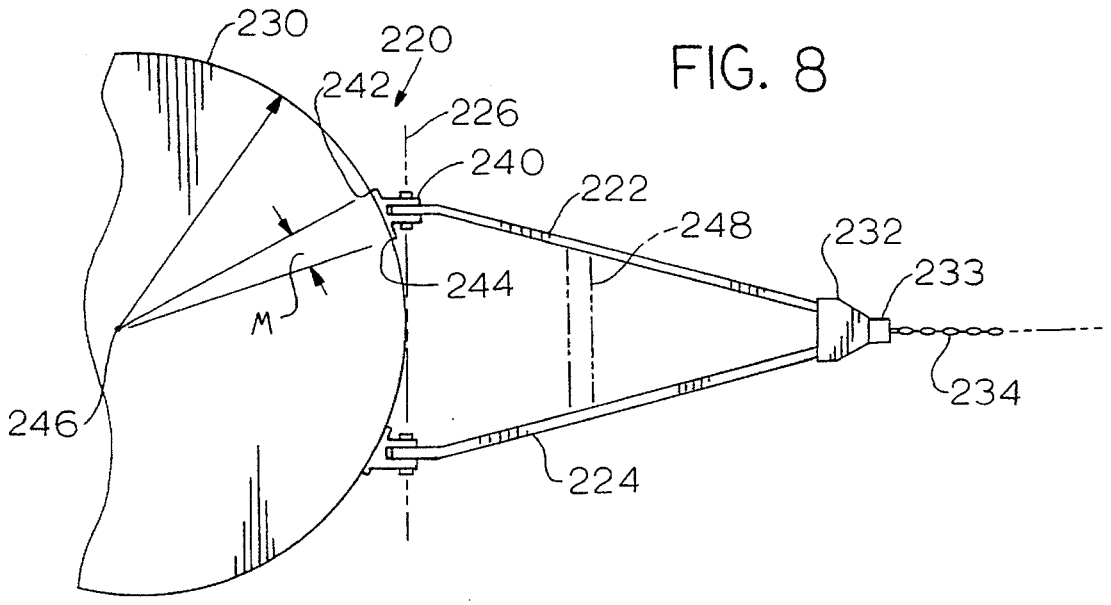
FIGS. 8 and 9 are plan views of systems constructed in accordance with other embodiments of the invention.

FIG. 8 illustrates a system 220 similar to that of FIG. 6, except that it includes two rigid beams, 222, 224 that resist column collapse as well as transmitting tension. The beams, whose inner ends are pivotally connected about an axis 226 to the turret 230, have outer ends connected to a coupling 232 that has a chain stopper 233 which connects to a mooring chain device 234. Because the beams transmit all horizontal and vertical components of force from device 234 to the turret, the beams and their pivot joints must be very strong. As a result, this system is not preferred. A pivot joint at 240 of the torque enhancer is shown mounted to turret locations 242, 244 that are spaced apart by an angle M of 10° about the turret axis 246. It would be possible to add a cross arm 248 to connect the beams 222, 224. However, each beam would still act as a separate member that transmits tension and compression forces to a turret location such as at pivot joint 240 and to a coupling 232 that connects to the chain device.

Figure 9:
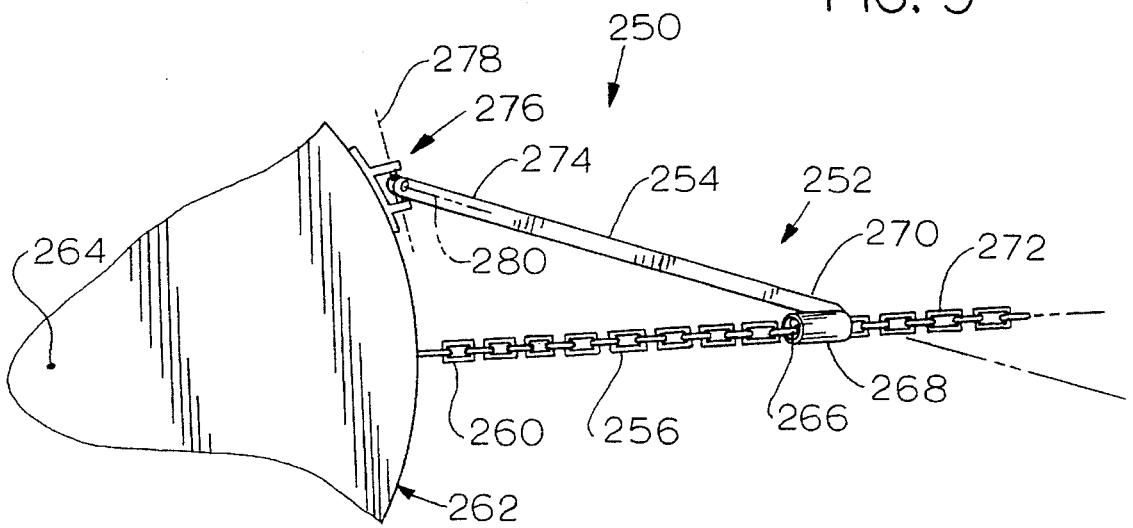

FIG. 9 illustrates a system 250 with a torque enhancer 252 that comprises a single rigid beam 254 and a chain section 256. An inner end 260 of the chain section is fixed to a turret 262 that rotates about axis 264. A chain location 266 of a mooring chain device 272 is clamped by a clamp 268 that is fixed to the outer end 270 of the beam. The chain section 256 is preferably part of a continuous chain device 272. The inner end 274 of the beam is connected to the turret through a universal joint 274 that permits pivoting about a horizontal axis 278 and an axis 280 that is perpendicular thereto.

The resistance to rotation of the turret back to its quiescent position, occurs especially in large turrets having bearing diameters of at least nine meters. Although roller bearings are preferred to rotatably support the turret (especially at the upper bearing) to provide low friction turret rotation, foundries are not available that can make single forgings of over nine meters diameter. As a result, such large turrets have commonly used slider bearings consisting of stainless steel against lubricated bronze. In practice, such bearings often have a much higher friction coefficient than roller bearings, so that greater torque is required to rotate the turret back towards its quiescent position. Also, such large turrets are usually very heavily loaded, so that there is large bearing friction. Applicant's torque enhancer is therefore especially useful in such large turrets. In order to significantly increase torque, applicant's torque enhancer preferably extend radially beyond the turret by more than half the turret radius (e.g. R in FIG. 3), and more preferably by at least the turret radius. The torque enhancer will almost always extend by more than one meter beyond the turret periphery. The turret is that structure which does not pivot (usually less than 10°) about any horizontal axes. Usually all portions of the turret can support large downward forces such as the downward component of force applied by one of the chain devices in the quiescent condition; then, the downward force applied by a chain device is about 85% of the weight in air of the chain device portion that lies above the seafloor (where the chain device is of steel having a specific gravity of about 8), and is usually many tons.

Thus, applicant provides an offshore system with torque enhancers that provide additional torque to rotate a turret back towards its quiescent position. The torque enhancer has an inner end mounted at spaced locations on the turret and has an outer end lying much further from the turret axis than the turret periphery, preferably at least one meter further. A mooring chain device is coupled to the outer end of the torque enhancer to apply horizontal components of forces thereto, or at least horizontal subcomponents that tend to merge turret rotation, to increase the torque applied to the turret. The torque enhancer can include two separate members each having inner ends mounted at circumferentially spaced locations on the turret and having adjacent outer ends coupled to the mooring chain device. Where the members are rigid beams that resist column collapse, they can hold a guide that is slidably engaged with the mooring chain device. Where the members are tension devices that cannot withstand compression loading, the outer ends of the members are substantially fixed to the mooring chain device.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore system that includes a vessel with a hull which can weathervane, a turret which has a periphery, a bearing structure which supports said turret in relative rotation about a substantially vertical axis on said hull, said turret having a radius as measured from said axis to said periphery, and a plurality of mooring chain devices that extend at downward inclines substantially from said turret to the seafloor and that urge said turret toward a predetermined quiescent rotational orientation about said vertical axis relative to the seafloor, characterized by:

a torque enhancer having an inner end mounted to locations on said turret which are angularly spaced apart with respect to said axis, and having an outer end extending radially beyond said turret periphery by at least the turret radius;

a first of said chain devices is coupled to said outer end of said torque enhancer to apply at least a portion of horizontal components of force thereto that urge turret rotation when said turret turns about said vertical axis.

2. The system described in claim 1 wherein:

said torque enhancer comprises a structure which includes a pair of members with radially inner ends and with radially outer ends, said inner ends being angularly spaced apart by at least 10° and being pivotally coupled to said turret to enable said inner ends to pivot about horizontal axes;

said first chain device is coupled to said outer ends of said members to apply at least subcomponents of horizontal forces thereto.

3. The system described in claim 1 wherein:

said torque enhancer comprises a pair of members that are each substantially rigid beams that resist compression, and said torque enhancer includes a chain device guide coupled to said outer ends of said members, with the outer ends of said members being free to move up and down with respect to said hull.

4. The system described in claim 2 wherein:

each of said members comprises an elongated tension member which can transmit tension forces but substantially not compression or bending forces;

the outer ends of said tension members are each fixed to said chain device.

5. The system described in claim 1 wherein:

said inner end of said torque enhancer has locations attached to said turret which are angularly spaced about said axis by at least 10°.

6. The system described in claim 1 wherein:

said outer end of said torque enhancer lies more than one meter further from said axis than the periphery of said turret, and said inner end of said torque enhancer has locations attached to said turret which subtend an angle of at least 10°.

7. An offshore system that includes a vessel which has a hull that floats at the sea surface and that can weathervane and which has a turret that has a turret periphery and that is rotatably mounted on said hull about a vertical axis, said turret having a radius as measured from said axis to said turret periphery, wherein the system includes a plurality of chain devices that each extends at a downward incline from substantially said turret to the seafloor, comprising:

a torque enhancer which has an inner end pivotally connected to said turret at locations that are angularly spaced about said vertical axis, and which has an outer end that can move with upward and downward directional components independently of said hull, said outer end lying further from said axis than said inner end by a distance from said turret periphery that is greater than one-half of said turret radius, with said outer end of said torque enhancer being coupled to a first of said chain devices to transmit to said turret, at least portions of horizontal components of tension forces in said first chain device.

8. The system described in claim 7 wherein:

said torque enhancer includes a pair of members that are each tension members that can transmit tension forces but substantially not compression or bending forces.

9. An offshore system that includes a vessel which has a hull that floats at the sea surface and that can weathervane and which has a turret that is rotatably mounted on said hull about a vertical axis, wherein the system includes a plurality of chain devices that each extends at a downward incline from substantially said turret to the seafloor, comprising:

a pair of tension members that can transmit tension forces but substantially not compression or bending forces, said members each having an inner end pivotally connected about a largely horizontal axis to said turret and having an outer end, said inner ends being angularly spaced about said axis and said outer ends lying further from said axis than said inner ends, with said outer ends of said members being coupled to a first of said chain devices to transmit, through said members to said turret, at least portions of horizontal components of tension forces in said chain device.

10. An offshore system that includes a vessel which has a hull that floats at the sea surface and that can weathervane and which has a turret that is rotatably mounted on said hull about a vertical axis, wherein the system includes a plurality of chain devices that each extends at a downward incline from substantially said turret to the seafloor, with a first of said chain devices having an inner end connected to said turret, comprising:

a member that has a member inner end pivotally connected about a largely horizontal axis to said turret and that has an outer end, said first chain device inner end being angularly spaced about said axis from said member inner end and said member having a member outer end lying further from said axis than said member inner end, with said member outer end being coupled to said first chain device to transmit to said turret, at least portions of horizontal components of tension forces in said first chain device.

11. A method for use with an offshore system that includes a weathervaning vessel that floats at the sea surface and that includes a hull and a turret that is rotatably mounted on said hull about a substantially vertical axis, wherein the system includes a plurality of chain devices extending at downward inclines and different directions to the seafloor and having upper ends coupled to said turret, comprising:

pivotally connecting an inner end of a torque enhancer to said turret at locations spaced about said turret axis, and coupling an outer end of said torque enhancer to a first of said chain devices so at least horizontal subcomponents of tension forces in said first chain device that do not pass through said vertical axis are transmitted through said torque enhancer to said turret, while allowing said outer end of said torque enhancer to move up and down substantially without restraint from said hull.

12. The method described in claim 11 wherein:

said step of connecting an inner end of a torque enhancer includes pivotally connecting inner ends of a pair of members which transmit substantially only tension forces, to said locations at said turret, and transmitting substantially only tension forces through said members between said first chain device and said turret.

* * * * *